US008094857B2

(12) United States Patent
Upham et al.

(10) Patent No.: US 8,094,857 B2
(45) Date of Patent: Jan. 10, 2012

(54) SING-ALONG STAND WITH PERFORMANCE INTERFACE CONFIGURED TO DISPLAY A MUSIC STORAGE/PLAYBACK DEVICE

(75) Inventors: Adriana G. Upham, Pembroke Pines, FL (US); Joshua K. Goldstein, Plantation, FL (US); Kuni Goda, Sunrise, FL (US); Raul Febles, Weston, FL (US); Jayson Pegler, Moorpark, CA (US); Tom Kwon, San Pedro, CA (US); Matthew Paprocki, Los Angeles, CA (US)

(73) Assignee: Imation Corp., Oakdale, MN (US)

( * ) Notice: Subject to any disclaimer, the term of this patent is extended or adjusted under 35 U.S.C. 154(b) by 789 days.

(21) Appl. No.: 12/283,568

(22) Filed: Sep. 12, 2008

(65) Prior Publication Data

US 2010/0067729 A1 Mar. 18, 2010

(51) Int. Cl.

| | |
|---|---|
| ***H04R 25/00*** | (2006.01) |
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl. ..... 381/363; 381/366; 381/374; 381/375

(58) Field of Classification Search ..... 381/363, 381/375, 374

See application file for complete search history.

(56) References Cited

U.S. PATENT DOCUMENTS

| | | | | |
|---|---|---|---|---|
| D417,872 | S | 12/1999 | Monson | |
| D460,064 | S | 7/2002 | Solland | |
| 6,487,298 | B1 * | 11/2002 | Hacker | 381/363 |
| D467,241 | S | 12/2002 | Solland | |
| 7,134,876 | B2 | 11/2006 | Hou | |
| 7,327,560 | B1 | 2/2008 | Tabasso et al. | |
| 2006/0023911 | A1 * | 2/2006 | Eagan | 381/362 |
| 2007/0072557 | A1 | 3/2007 | Chiu | |
| 2007/0175313 | A1 * | 8/2007 | Vandervliet | 84/379 |
| 2008/0253601 | A1 * | 10/2008 | Hilderman | 381/363 |
| 2009/0116656 | A1 * | 5/2009 | Lee et al. | 381/59 |
| 2011/0132172 | A1 * | 6/2011 | Gueneux | 84/454 |

OTHER PUBLICATIONS

"Tech Talk for Families," Review: iPay Music Sing-A-Song Microphone, http://www.techtalkforfamilies.com/review/toys/review_iplay_music_sing_a_song_microph, Jul. 22, 2008, 3 pages.

Prosecution history for U.S. Appl. No. 29/313,624, "Sing-Along Stand," Upham et al., filed Jan. 27, 2009, 43 pp.

* cited by examiner

*Primary Examiner* — Victor A Mandala

(74) *Attorney, Agent, or Firm* — Shumaker & Sieffert, P.A.

(57) ABSTRACT

A microphone speaker system includes a base having a speaker, a stand extending between a first end and a second end, the first end coupled to the base, a performance interface coupled to the second end of the stand, and a microphone support coupled to the performance interface. The performance interface is configured to removably retain a music storage/playback device that electrically connects with the speaker through the base. The microphone support is coupled to the performance interface and configured to adjustably support a microphone that electrically connects with the speaker through the base.

20 Claims, 5 Drawing Sheets

SING-ALONG STAND WITH PERFORMANCE INTERFACE CONFIGURED TO DISPLAY A MUSIC STORAGE/PLAYBACK DEVICE

THE FIELD

Embodiments generally relate to sing-along stands, and more particularly, to a sing-along stand having an interface that holds and orients towards a performer a display screen of a music storage/playback device.

BACKGROUND

Music storage devices are popular. Owners and users of music storage devices enjoy singing along to the songs they have stored, downloaded and/or saved.

For this reason, there is a need for the present invention.

SUMMARY

One aspect provides a microphone speaker system. The system includes a base having a speaker, a stand extending between a first end and a second end, the first end coupled to the base, a performance interface coupled to the second end of the stand, and a microphone support coupled to the performance interface. The performance interface is configured to removably retain a music storage/playback device that electrically connects with the speaker through the base. The microphone support is coupled to the performance interface and configured to adjustably support a microphone that electrically connects with the speaker through the base.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

Embodiments provide a sing-along stand system sold under the trademark SING STAND™ configured to enable a person to sing along with music stored on a music storage/playback device, such as an MP3 player. The sing-along stand system includes multiple full-range speakers with inputs for musical instruments (such as a guitar), dual microphone inputs for performing duet performances, and a voice controller for quelling the vocals of the stored/played music. Embodiments of the sing-along stand system include a performance interface including a microphone holder. The performance interface retains the music storage/playback device so that the singer may sing along to the music without having to hold onto the music storage/playback device.

Figure 1:
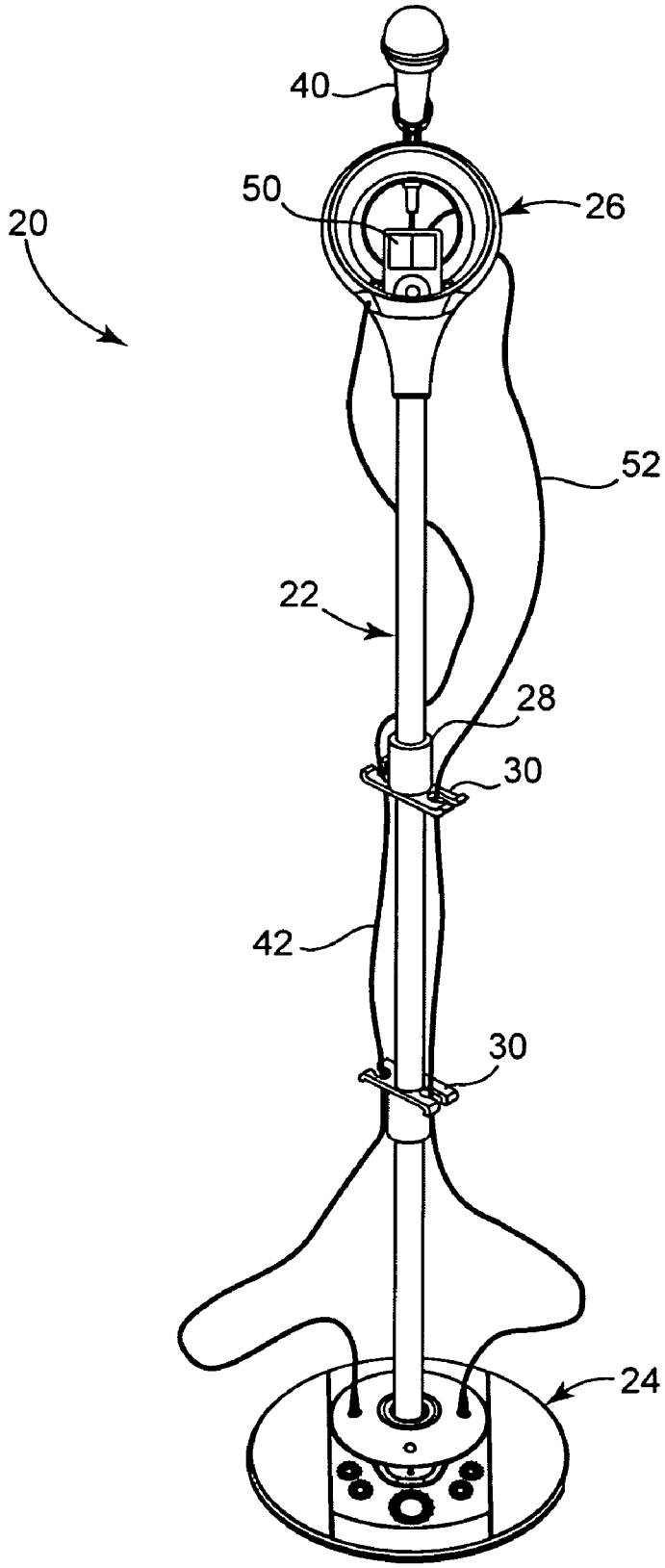
FIG. 1. is a perspective view of a microphone speaker system including a performance interface according to one embodiment.

FIG. 1. is a perspective view of a microphone sing-along stand/speaker system 20 according to one embodiment. System 20 includes a stand 22 extending between a base 24 and a performance interface 26. In one embodiment, the stand 22 is fabricated from metal and includes a chrome finish and an adjustment mechanism 28 configured to enable a performer to adjust a height of the performance interface 26 above the base 24. One or more clips 30 are provided that are removably attachable to the stand 22 and configured to retain electrical cords.

In one embodiment, the base 24 provides an electrical assembly including at least one speaker 62 (FIG. 2) and multiple input jacks. A microphone 40 is attachable to the performance interface 26 and includes a cable 42 that electrically plugs in to the base 24. Sound input into the microphone 40 is mixed and amplified through the speakers in the base 24. In one embodiment, the performance interface 26 retains a music storage/playback device 50 having a cable 52 that electrically plugs into the base 24. The speakers in the base 24 are configured to output and amplify the music stored on the music storage/playback device 50. The system 20 is configured to mix the vocals of the performer input into the microphone 40 with the music from the device 50 and amplify the combined sound through the speakers. In this manner the system 20 combines the input to the microphone 40 with the music played off of the device 50 to enable the performer to sing along with the songs saved on the device 50.

Figure 2:
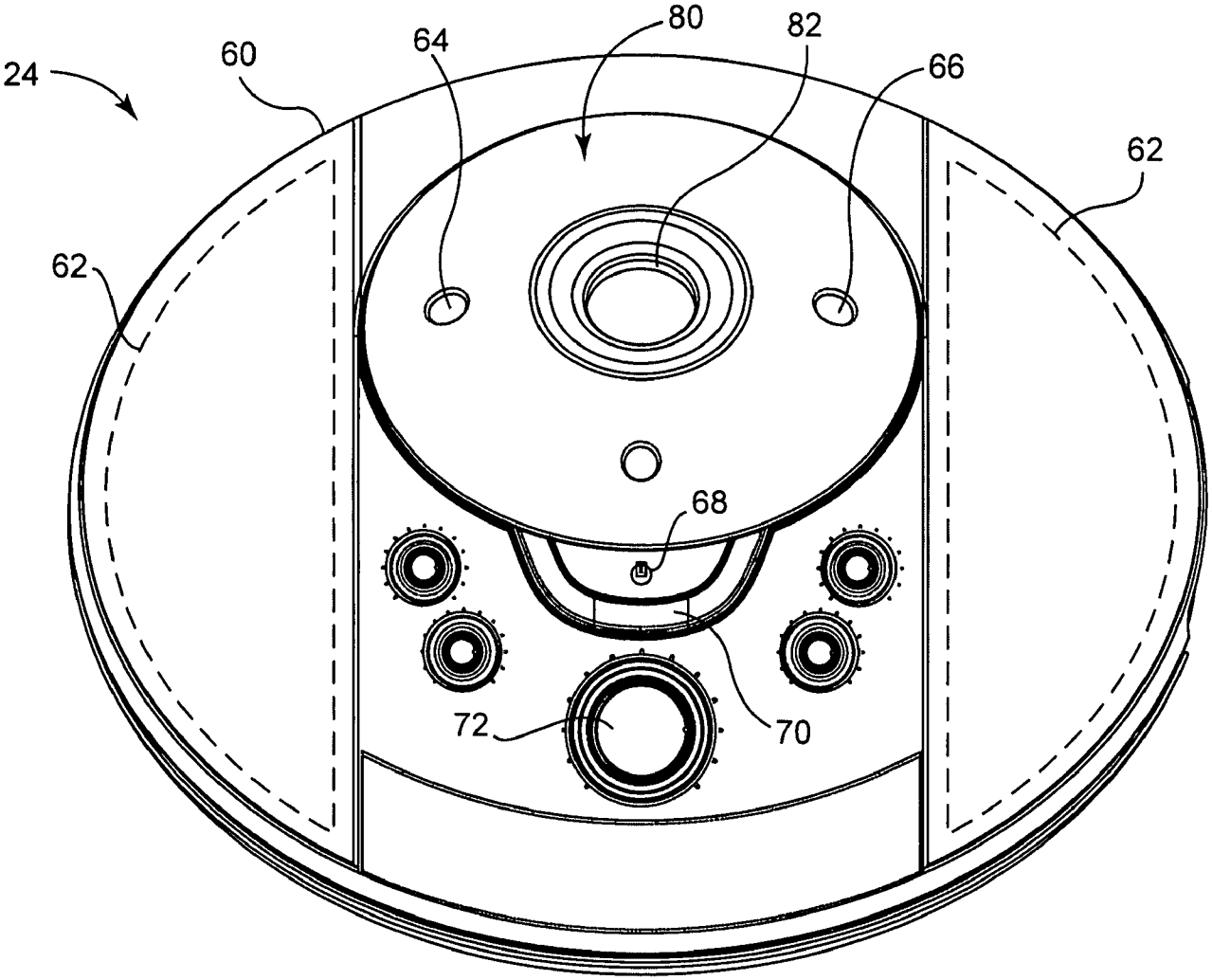
FIG. 2 is a top perspective view of a base of the system illustrated in FIG. 1.

FIG. 2 is a top perspective view of the base 24. The base 24 includes a housing 60 enclosing electronics that operate the speakers 62, microphone jack 64, headphone jack 66, power 68, auto voice control 70, and volume 72. A central portion 80 of housing 60 includes a recess 82 configured to receive the stand 22 (FIG. 1).

The base 24 includes at least one speaker 62 and preferably multiple speakers. In one embodiment, the speakers 62 include four-inch full-range speakers placed in the base 24 behind a screen or perforated cover. In one embodiment, the microphone jack 64 is a ¼ inch jack configured to receive the cable 42 (FIG. 1) to electrically connect the microphone 40 with the electronics of the base 24 and the speakers 62. In one embodiment, the headphone jack 66 is a ⅛ inch jack configured to receive the cable 52 from the music storage/playback device 50 to enable playing the music saved on the storage device 50 through the speaker 62.

In one embodiment, the power button 68 includes a lighted indicator of the on/off status of the system 20. In one embodiment, the volume button 72 is an incrementally positionable volume dial that can be adjusted, for example, by the performer's foot. In one embodiment, the auto voice control 70 includes an equalizer that is integrated with the electronics of the base 24 and configured to reduce the vocal component of the music played through the music storage/playback device 50. The auto voice control 70 is adjustable to prevent the vocals from the stored music from "drowning out" the vocals of the performer.

Figure 3:
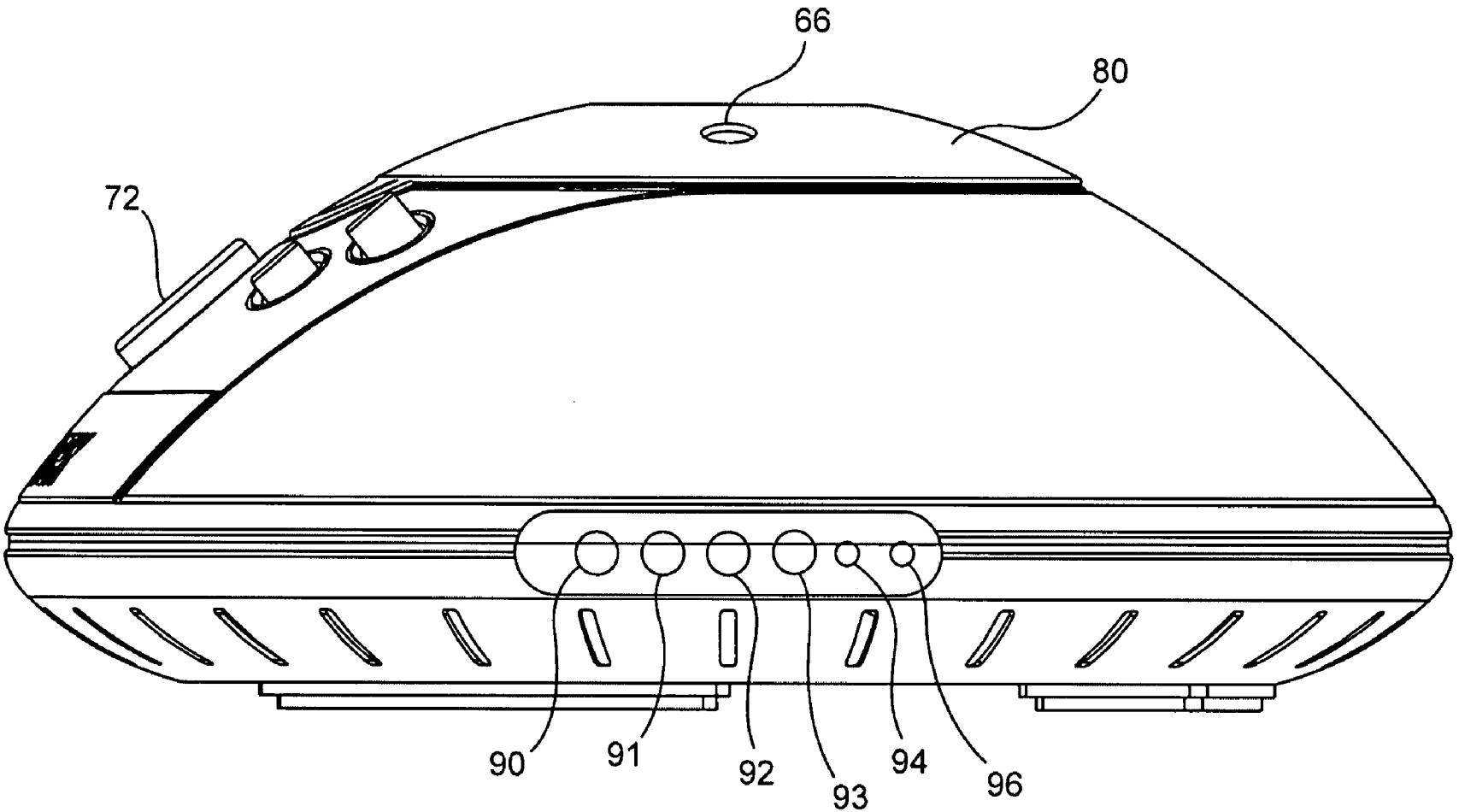
FIG. 3 is a side view of the base illustrated in FIG. 2.

FIG. 3 is a side view of the base 24. In one embodiment, the base 24 provides additional input jacks including another ¼ inch microphone jack 90, a ¼ inch instrument jack 91, a white RCA jack 92, a red RCA jack 93, another ⅛ inch headphone jack 94, and an AC adapter 96. The additional microphone jack 90 is configured to electrically communicate with microphone jack 64 and the speakers 62 to enable duet vocal performances. The instrument jack 91 electrically communicates with the speakers 62 and provides an input for a musical instrument, such as a guitar, to enable the performer to be accompanied by an instrument while singing. In one embodiment, the electronics within the base 24 are battery operated. In another embodiment, the electronics within base 24 are powered by an alternating current power supply plugged into AC adapter 96.

Figure 6:
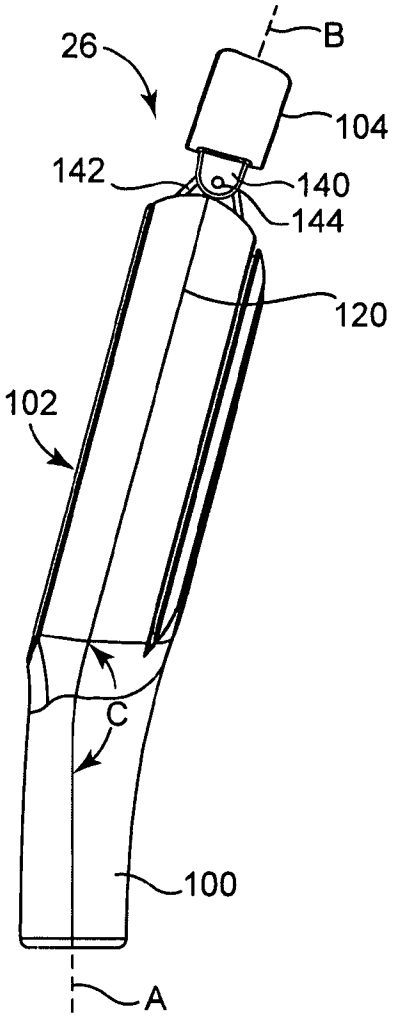
FIG. 6 is a side view of the performance interface illustrated in FIG. 4.
Figure 5:
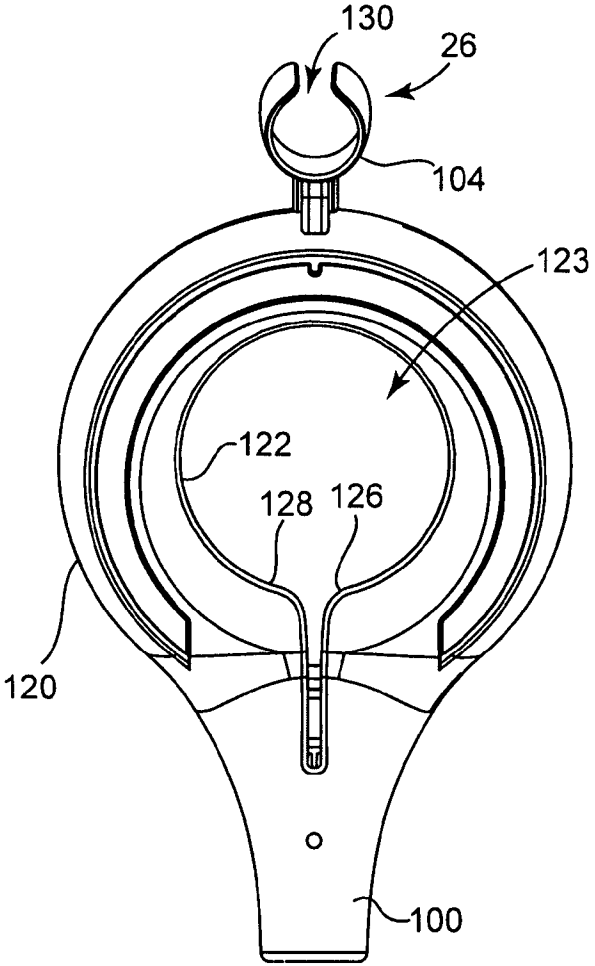
FIG. 5 is a back view of the performance interface illustrated in FIG. 4.
Figure 4:
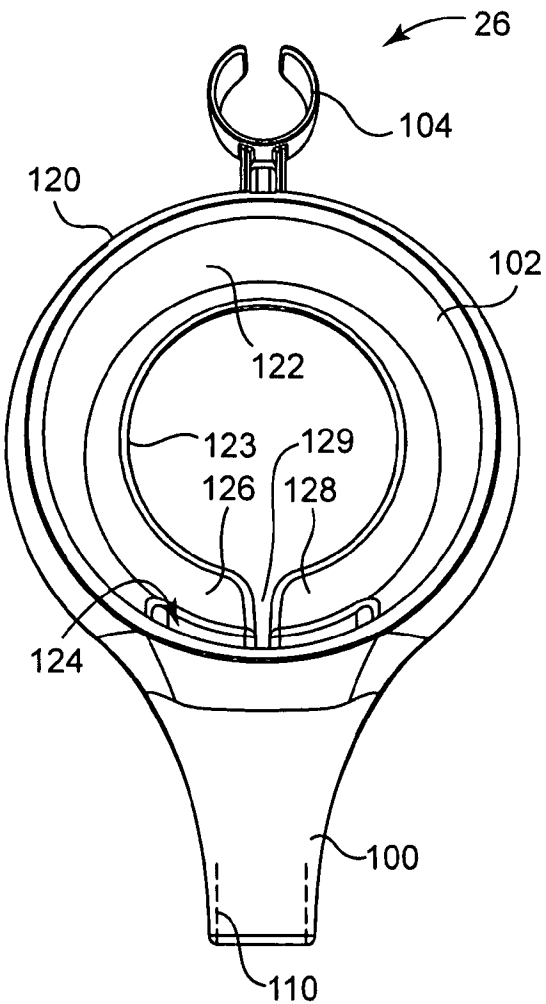
FIG. 4 is a front view of the performance interface illustrated in FIG. 1.

FIG. 4 is a front view, FIG. 5 is a back view, and FIG. 6 is a side view of the performance interface 26 according to one embodiment. The performance interface 26 includes a receptacle member 100, a display 102 coupled to the receptacle member 100, and a microphone support 104 coupled to the display 102.

In one embodiment, the receptacle member 100 is integrally formed with the display 102 and defines a recess 110 that is sized to receive a top end of the stand 22 (FIG. 1). In one embodiment, the display 102 is formed of two mating halves that are joined along a part line, where the display 102 is smoothly formed in an annular ring. In one embodiment, the display 102 has no electronic components and has an absence of corners. Other fabrication approaches for the display 102 are also acceptable.

In one embodiment, the display 102 includes an outside periphery 120 that is smoothly blended with an inside periphery 122 to form a window 123 sized to frame the music storage/playback device 50 (FIG. 1). The outside periphery 120 is smoothly blended with the inside periphery 122 to form the annular ring, which is characterized as having an aesthetic compound curvature.

In one embodiment, a socket 124 is formed at a bottom of the display 102 adjacent to the receptacle member 100 (as oriented in FIG. 4), where the socket 124 is sized to receive the music storage/playback device 50. The socket 124 is suitably sized to receive the device 50 and, as an example, the socket 124 is sized to receive a 1-4 gigabyte iPod™ digital music storage device or MP3 player. In one embodiment, a first wing 126 is provided that is separated from a second wing 128 by a gap 129, where the wings 126, 128 extend from a back side of the socket 124 to form an extension of the inside periphery 122. The gap 129 is suitably sized to accommodate draping the cable 52 from behind the music storage/playback device 50 when the device 50 is engaged with the socket 124. In an exemplary embodiment, the wings 126, 124 extend away from a back edge of the socket 124 to provide a back support for the music storage/playback device 50.

In one embodiment, the receptacle member 100 is oriented along a central axis A and the display 102 is oriented along an axis B such that the display 102 is disposed at an angle C relative to the central axis A. In one embodiment, the angle C is selected to be less than 180 degrees such that the display 102 tilts "upward" to face a standing performer who is taller than the sing-along stand system 20.

In one embodiment, the receptacle member 100 and the display 102 are formed as a single unit to which the microphone support 104 is separately attached. For example, one embodiment of the microphone support 104 includes ears 140 (FIG. 6) that are mounted to a flange 142 of display 102. The ears 140 are configured to pivot about a pivot point 144 connected between ears 140 and flange 142. In this manner, the microphone support 104 is configured to be moved independently from the display 102. In one embodiment, the microphone support 104 defines a conical sleeve including a slot 130 that is sized to provide clearance for the cable 42 (FIG. 1) extending from microphone 40. To stow the microphone 40, the cable 42 is passed through the slot 130 and the microphone 40 is frictionally supported by the conical sleeve of the microphone support 104.

Suitable materials for forming performance interface 26 include plastic or metal. In one embodiment, the performance interface 26 is formed of plastic and includes a satin finish painted over the plastic.

Figure 7:
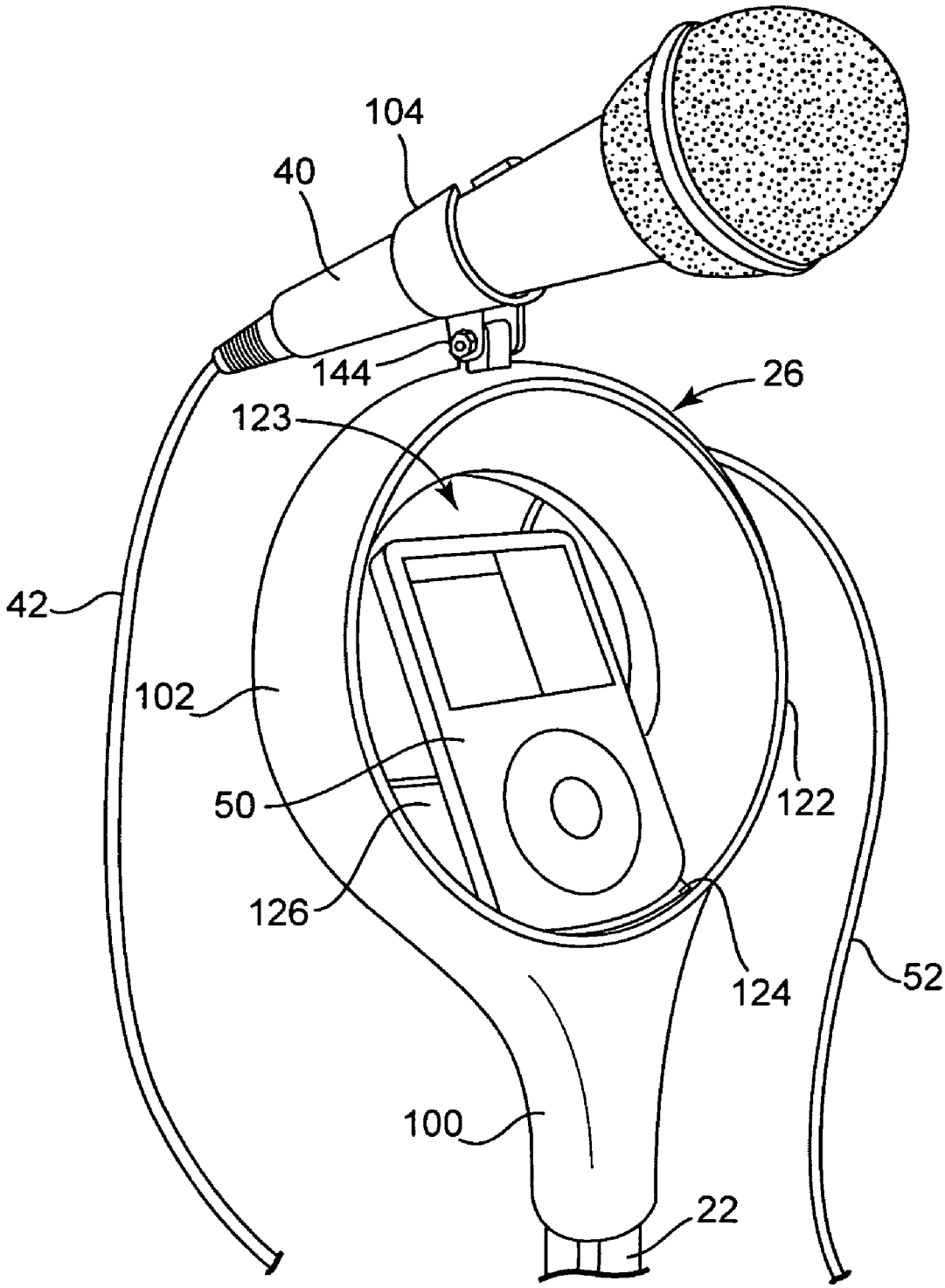
FIG. 7 is a perspective view of a microphone and a music storage/playback device removably retained by the performance interface illustrated in FIGS. 1 and 4.

FIG. 7 is a perspective view of the performance interface 26 supporting the microphone 40 and the music storage/playback device 50. The receptacle member 100 is attached to a top end of the stand 22. The music storage/playback device 50 is inserted into the socket 124 and rests against wings 126, 128 to recline at the angle C, which orients the data screen of the device 50 toward the performer. The music storage/playback device 50 is framed within window 123 formed by display 102 for easy viewing. The microphone 40 is removably retained by the microphone support 104, which is moveable independent of the display 102.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of sing-along stands configured to removably retain music storage devices as discussed herein.

What is claimed is:

1. A microphone speaker system comprising:

a base comprising a speaker;

a stand extending between a first end and a second end, the first end coupled to the base;

a performance interface coupled to the second end of the stand, the performance interface configured to removably retain a music storage/playback device that electrically connects with the speaker through the base; and a microphone support coupled to the performance interface, the microphone support configured to adjustably support a microphone that electrically connects with the speaker through the base.

2. The microphone speaker system of claim 1, wherein the performance interface comprises:

a ring including an inside periphery and an outside periphery, and a socket formed in the inside periphery of the ring that is sized to removably retain the music storage/playback device.

3. The microphone speaker system of claim 2, wherein the microphone support comprises a sleeve coupled to the outside periphery of the ring.

4. The microphone speaker system of claim 3, wherein the sleeve comprises a conical sleeve including a slot configured to enable removal of the microphone from the sleeve.

5. The microphone speaker system of claim 3, wherein the performance interface defines a receptacle member configured to couple to the second end of the stand, and the ring comprises a substantially circular ring integrally formed with the receptacle member, the socket disposed adjacent to the receptacle member and the sleeve axially aligned with the socket 180 degrees around the ring opposite the socket.

6. The microphone speaker system of claim 5, wherein the receptacle member is aligned with a central axis and the ring is oriented on a second axis non-parallel with the central axis such that a front of the ring is tilted up toward a standing performer.

7. The microphone speaker system of claim 6, wherein the socket is aligned with the second axis and configured to orient a display of the music storage/playback device toward the standing performer.

8. The microphone speaker system of claim 2, wherein the inner periphery of the ring defines a window of the performance interface, the window sized to form a frame around the music storage/playback device.

9. The microphone speaker system of claim 8, wherein the socket is formed at a bottom of the window and the ring further comprises a first wing extending from the socket to the inside periphery and a second wing extending from the socket to the inside periphery.

10. The microphone speaker system of claim 9, wherein the first wing is spaced apart from the second wing to comprise a vertical support for the music storage/playback device inserted into the socket.

11. The microphone speaker system of claim 1, wherein the performance interface is characterized by an absence of electronic components.

12. The microphone speaker system of claim 1, wherein the base comprises an input port configured to enable electrical communication between a musical instrument connected to the input port and the speaker.

13. A performance interface for a microphone stand, the performance interface comprising:

a receptacle member configured to couple to an end of the microphone stand; and a display integrally formed with the receptacle member, the display comprising a periphery, a window formed within the periphery, and a socket formed in the periphery that is sized to removably retain a music storage/playback device within the window.

14. The performance interface of claim 13, wherein the display comprises an outside periphery and an inside periphery that defines the window, the socket formed in the inside periphery.

15. The performance interface of claim 14, wherein the inside periphery comprises a first wing separated from a second wing by a gap, the first and second wings extending from a back side of the socket.

16. The performance interface of claim 13, wherein the periphery of the display is substantially circular.

17. The performance interface of claim 16, wherein the display comprises a substantially annular ring.

18. The performance interface of claim 13, wherein the display is integrally formed along an axis that is non-parallel to a central axis of the receptacle member.

19. The performance interface of claim 13, further comprising:

a microphone support coupled to the display opposite the socket.

20. The performance interface of claim 19, wherein the microphone support comprises an ear that is movably coupled to a flange formed on the periphery of the display.

* * * * *